US009098995B2

(12) United States Patent
Marafioti et al.

(10) Patent No.: US 9,098,995 B2
(45) Date of Patent: Aug. 4, 2015

(54) DETERMINING REAL-TIME DELAY OF TRANSPORT

(71) Applicant: Amadeus S.A.S., Sophia Antipolis (FR)

(72) Inventors: Vincenzo Marafioti, Antibes (FR); Joel Cordesses, Antibes (FR); Richard Savornin, Valbonne (FR)

(73) Assignee: Amadeus S.A.S., Biot (FR)

( * ) Notice: Subject to any disclaimer, the term of this patent is extended or adjusted under 35 U.S.C. 154(b) by 119 days.

(21) Appl. No.: 13/722,441

(22) Filed: Dec. 20, 2012

(65) Prior Publication Data

US 2014/0180495 A1 Jun. 26, 2014

(51) Int. Cl.

| | |
|---|---|
| ***G08G 9/00*** | (2006.01) |
| ***G08G 1/127*** | (2006.01) |
| ***B61L 27/00*** | (2006.01) |
| ***B61L 15/00*** | (2006.01) |

(52) U.S. Cl.

CPC ..... *G08G 9/00* (2013.01); *B61L 15/009* (2013.01); *B61L 27/0077* (2013.01); *G08G 1/127* (2013.01)

(58) Field of Classification Search

CPC ..... G06Q 10/10; G01C 21/3469; G01C 21/3492; G08G 1/0104; G08G 9/00; G08G 1/087; B60M 3/00; G01S 21/3476; G01S 21/3614; B61L 27/0022; B61L 27/0027; B61L 15/009; B61L 27/0016; B60T 7/12; B60T 8/1755; G01Q 10/06

USPC ..... 701/532, 533, 1, 70, 117; 246/5, 182 C; 718/102; 340/906

See application file for complete search history.

(56) References Cited

U.S. PATENT DOCUMENTS

| | | | | |
|---|---|---|---|---|
| 5,177,684 | A * | 1/1993 | Harker et al. | 701/117 |
| 5,346,163 | A * | 9/1994 | Momma et al. | 246/5 |
| 5,487,516 | A * | 1/1996 | Murata et al. | 246/182 C |
| 2006/0089787 | A1 * | 4/2006 | Burr et al. | 701/202 |
| 2009/0043486 | A1 * | 2/2009 | Yang et al. | 701/117 |
| 2011/0178689 | A1 * | 7/2011 | Yasui et al. | 701/70 |

(Continued)

FOREIGN PATENT DOCUMENTS

| | | | |
|---|---|---|---|
| EP | 2065867 | A1 | 6/2009 |
| JP | 06044495 | A | 2/1994 |

(Continued)

OTHER PUBLICATIONS

European Patent Office, Search Report issued in European Application No. 12290452.7 dated May 16, 2013.

*Primary Examiner* — Tuan C. To
*Assistant Examiner* — Yuri Kan
(74) *Attorney, Agent, or Firm* — Thompson Hine LLP

(57) ABSTRACT

A delay of a scheduled transport which runs along a route according to a timetable is determined The route comprises at least one leg. Determining the delay is based on a detailed reference schedule indicating arbitrary time-stamped reference positions of a transport that is on time. A request is received for the transport's delay by a user device located on the transport. The request indicates at least the current position of the transport. The transport's delay is calculated on the basis of the current position indicated in the request, a timestamp and the corresponding time-stamped reference position of the detailed reference schedule. The calculated delay is returned to the user device. The calculated delay is stored into a logbook. In response to a request not indicating the current position of the transport, the delay is returned on the basis of the logbook.

18 Claims, 14 Drawing Sheets

(56) References Cited

U.S. PATENT DOCUMENTS

| | | | | |
|---|---|---|---|---|
| 2011/0178698 | A1* | 7/2011 | Aben et al. | 701/200 |
| 2012/0326891 | A1* | 12/2012 | Cross | 340/906 |
| 2013/0111483 | A1* | 5/2013 | Milic-Frayling et al. | 718/102 |

FOREIGN PATENT DOCUMENTS

| | | | |
|---|---|---|---|
| JP | 2010231303 | A | 10/2010 |
| JP | 2012008957 | A | 1/2012 |

* cited by examiner

- Arrival Station
- Departure Station
- Train ID
- ...

| TrainID | stID | lat | lng | ArrTD | DepTD | Dist_leg |
|---|---|---|---|---|---|---|
| Tr1 | St1 | 43,55 | 7,02 | - | 07:30 | |
| Tr1 | St2 | 43,59 | 7,12 | 07:38 | 07:40 | 11,63 |
| Tr1 | St3 | 43,70 | 7,28 | 08:01 | - | 20,50 |

3

| trainID | LegID | time | lat | lng | valid |
|---|---|---|---|---|---|
| Tr1 | 1 | 07:35 | 43.56 | 7.11 | Yes |
| Tr1 | 1 | 07:36 | 43.57 | 7.11 | Yes |
| Tr1 | 1 | 07:37 | 43.58 | 7.11 | No |
| Tr1 | 1 | 07:38 | 43.59 | 7.12 | Yes |
| Tr1 | 2 | 07:43 | 43.60 | 7.13 | Yes |
| Tr2 | 1 | 20:22 | 23.57 | 10.11 | |

4

Fig. 5

| trainId | realTime | planTime | lat | lng | stDep | stArr | planDep | planArr | realDep | realArr | delay |
|---|---|---|---|---|---|---|---|---|---|---|---|
| Tr1 | 7:46 | 7:36 | 43.57 | 7.11 | St1 | St2 | 07:30 | 07:38 | 07:30 | 07:48 | **10** |
| Tr1 | 8:12 | 7:52 | 43.65 | 7.25 | St2 | St3 | 07:40 | 08:01 | 07:50 | 08:21 | **20** |

Query timestamp

Planned Time

5

Leg

Delay calculation

Fig. 8

DETERMINING REAL-TIME DELAY OF TRANSPORT

FIELD OF THE INVENTION

The present invention generally relates to delay determination of scheduled transport and, more specifically, to providing real-time delay information about the transport to passengers with mobile user devices.

BACKGROUND

The travel time of transportation that runs along a predetermined route is one item of primary information relevant to most of the passengers. When travelling via conveyances or transports such as trains, buses, ships, airplanes or trams, passengers may want to know the exact transit time, departure time, and arrival time of the conveyance or transport. Passengers can consult official timetables published by operating companies, e.g., on the web. In general, these official timetables include the planned departure and arrival times for all locations along a certain travel route. However, the transport or conveyance may be delayed due to unexpected factors (e.g., rough weather, traffic situations, etc.) As a consequence, timetables may not accurately reflect the actual progression of the conveyance.

SUMMARY OF THE INVENTION

According to an embodiment of the present invention, a method of determining a real-time delay of a scheduled transport which runs along a route according to a timetable is provided. The route comprises at least one leg. Determining the real-time delay, or current time difference, between the real-time progression of the transport and the scheduled or expected progression of the transport is based on a detailed reference schedule which indicates arbitrary time-stamped reference positions of an on time transport. The method comprises a position-based determination and a time-based determination. The position-based determination comprises receiving a request for the transport's real time delay (i.e., a request for a progression update for the scheduled transport) by a user device located on the transport, the request indicating at least the current position of the transport, calculating the transport's real-time delay on the basis of the current position indicated in the request, a time-stamp and the corresponding time-stamped reference position of the detailed reference schedule, returning the calculated real-time delay to the requesting user device (i.e., transmitting the progression update to the user device), and storing the calculated real-time delay into a logbook database.

The time-based determination comprises returning the real-time delay on the basis of the logbook database containing real-time delay entries with respect to the transport in response to a request by a different or the same user device not indicating the current position of the transport.

According to another aspect, a computer system for determining the real-time delay of a scheduled transport as described above is provided.

According to another aspect, a non-transitory computer readable storage medium having computer program instructions stored therein, which, when executed on a computer system, perform the method as described above.

According to still another aspect, a computer program is provided which when executed on a computer system, causes the computer system to perform the method as described above.

Further aspects are set forth in the dependent claims.

BRIEF DESCRIPTION OF THE FIGURES

The embodiments of the present invention will be described with reference to the accompanying figures. Similar reference numbers generally indicate identical or functionally similar elements.

FIG. 5 depicts an exemplary detailed reference schedule database which may be employed in the present delay determination.

FIG. 8 shows an exemplary logbook database which may be employed in the present delay determination.

DETAILED DESCRIPTION OF THE FIGURES

Figure 1:
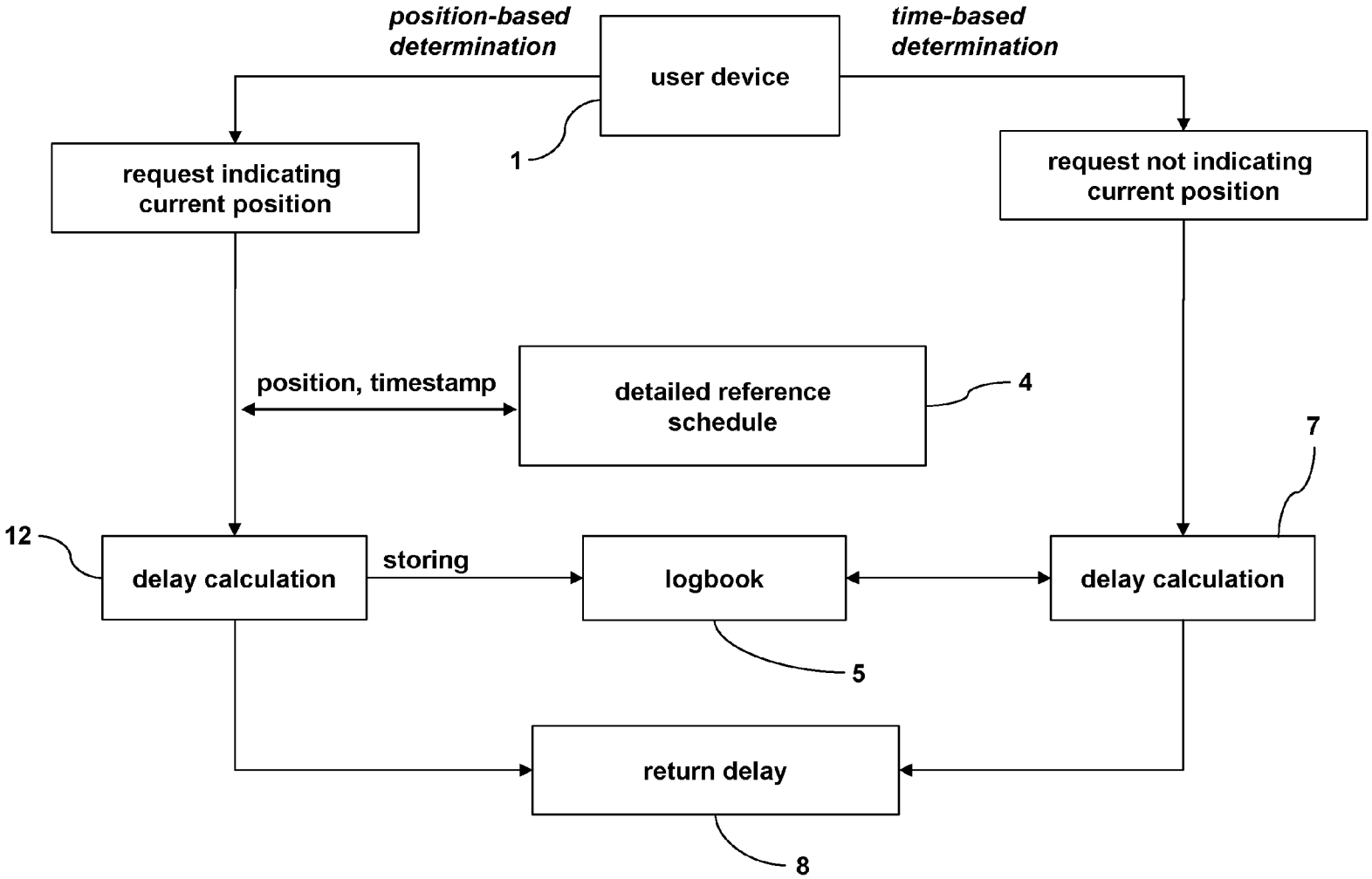
FIG. 1 depicts a flow diagram showing the principles of the present delay determination.

Before turning to the detailed description with reference to FIGS. 2 to 13, some general aspects will be set forth first on the basis of FIG. 1.

The present invention generally relates to scheduled transports which travel regularly according to a particular timetable. Such a scheduled transport may, for example, be a train (such as an international, a high-speed, a national, regional or a suburban train), a bus, a shuttle car, an airplane, a ship or a ferry, a tram or any other public transport.

Timetables are normally created and issued by the operator of the transport. For example, the SCNF creates and issues timetables for all the TGVs running in France, whereas the Deutsche Bahn generates and issues the timetables of the ICEs running in Germany. The operator makes the timetables available to the public and, in particular, to passengers at stations, via the Internet or at/in the transport itself. The timetables of the transport normally indicate the origin and the final destination of a transport as well as the intermediate stations. Furthermore, they normally indicate the departure time at the origin station and the arrival time at the final destination and as well as departure times and, optionally, arrival times at the intermediate stations.

By this, the timetables of the operators logically group the scheduled transports regarding their route and their travel time. Transports going on an identical route at identical times are hereinafter referred to as transports belonging to a particular "connection". For example, all trains running daily from Nice to Paris at 10 o'clock form such a connection. On the other hand, the term "route" refers to the way the scheduled transport progresses according to the timetable from the origin station to the final destination. For example, in case of the trains belonging to the aforementioned connection (i.e., the daily 10 o'clock TGV from Nice to Paris), the route is given by the rail tracks between Nice and Paris. Furthermore, in general, the route of a scheduled transport is composed of legs. In the following, the term "leg" refers to a part of the route between two subsequent stations listed in the timetable. Exceptionally, a route consists of only one leg if the timetable does not prescribe any intermediate stop between the origin station and the final destination. Normally, however, the route is divided into a plurality of legs. If, for example, the timetable indicates six intermediate stations between the origin and the final destination, the route is subdivided into seven legs.

Usually, passengers are not only interested in the planned arrival and departure times of a transport, which are set by the operator's timetable, but also in the actual progression of a particular transport they intend to use or they are currently using. For example, in order to minimize waiting times or choose a suitable connecting transport, it is beneficial for passengers to have knowledge whether their transport is currently perfectly on time, behind schedule or even before schedule. In this respect, the terms "delay" or "time difference" are used herein to cover all three of these possibilities. Hence, the delay is positive when the transport is behind schedule and will arrive at the next station probably later than indicated by the timetable. The delay is zero when the transport is on time and will probably arrive at the next station at the time indicated by the timetable. The delay is negative if the transport is before schedule and will thus probably reach the next station earlier than indicated by the timetable.

The delay information method/system presented herein allows a progression update for a scheduled transport that includes real-time delay information to be provided or transmitted to user devices which are not equipped with position determination functionality or are in situations in which a position determination is not possible. Furthermore, the method aims at improving the accuracy of the delay information provided to the passenger or other end-user.

On the one hand, the present delay determination is based on a reference schedule database 4 which is more detailed than the timetables issued by the transport operators. As outlined before, those operator timetables merely contain target times regarding the stops or stations of a transport. However, this information is presently considered to be insufficient because it does not provide any reference information for positions between the intermediate stations, i.e., within the legs. One possibility to supplement the operator timetables is to assume linear progression of the transport between the intermediate stations and, accordingly, to "fill in" the timetables by linear interpolation. However, presently, the detailed reference schedule database 4 is introduced which aims at reflecting the actual real-world progression of the on-schedule transport between its intermediate stations more accurately. For this purpose, the detailed reference schedule database 4 contains target time information for arbitrary locations along the route, in addition to the target time information at the intermediate stations which can be taken from the respective operator timetable. In other words, the detailed reference schedule database 4 does not only indicate the arrival and departure times of stations prescribed by the operator, but also and in particular includes additional time-stamped reference positions of a transport that is on time, the positions being arbitrary, i.e., independent from the stops or stations. The time stamps thus reflect the times at which the transport is expected to be in each of the reference positions. In a deployed system operating according to the delay determination presented herein, detailed reference schedule data will exist for each connection to be covered by the present delay determination. For example, referring again to the TGV example mentioned before, there will be detailed reference schedule data for the daily TGV from Nice to Paris departing from Nice at 10 o'clock and further detailed reference schedule data for the daily TGV from Nice to Paris departing from Nice at noon. There are several possibilities to establish such a detailed reference schedule database 4 which will be described further below. One possibility is the so-called "social approach" according to which data from position-based requests relating to transports that have been on time are collected. This detailed reference schedule database 4 allows determining the delay of the transport more precisely due to the increased granularity of the reference data, compared with the timetable-based approach only using scheduled stops as reference data.

On the other hand, the present delay determination method utilizes a logbook database, or logbook 5 in which real-time delay information about the transport in question is collected. The logbook 5 is filled with real-time delay information generated by position-based delay determination which is performed as follows (visualized by the left-hand branch of FIG. 1):

A passenger located on or at the transport is equipped with a mobile user device 1 such as a mobile phone, a smartphone, a laptop, a tablet computer etc. The user device 1 generates a request for the transport's real-time delay. This request includes at least the current position of the user device 1 which is identical to the current position of the transport. The request is issued to a server or may, alternatively, be processed locally at the user device 1 using a cache mechanism (this will be explained in more detail below). The request is then received, either by the server or internally by the user device 1. Next, the request is processed in order to calculate the delay of the transport. On the basis of the current position indicated in the request and, in addition, a time-stamp associated with the request, the detailed reference schedule database 4 is consulted and respective time-stamped reference positions regarding on-time progression of the transport are used to calculate the real-time delay of the transport (at box 12 in FIG. 1). The specifics of the delay calculation are described further below, and may include determining an expected time for the transport to reach the current position based the detailed reference schedule database 4. The resulting delay information is, at box 8 in FIG. 1, returned to the user device 1 (again, either by the server or internally within the user device 1). In addition, however, the calculated delay information is logged and stored in the logbook 5.

The logbook 5 filled with the delay information obtained by the position-based determination facilitates a purely time-based determination (depicted on the right-hand branch of FIG. 1) which works without any position determination by the user device 1. The user device 1—which may be the same or another user device that has issued a position-based request beforehand-generates a time—based request which, in contrast to the position-based request described above, does not include an indication of the user device's 1 current position. The reason for this could be that the device 1 is incapable of determining its current position, either because it is not equipped with any position-determination capabilities, it is only equipped with inaccurate position determination capabilities which are insufficient for the purpose of the present delay determination or a position determination is impossible at the time of the request, e.g., due to lack of coverage, lack of free line of sight to satellites, remoteness from the transport (e.g., an interested user at home), etc. Provided that logbook data associated with the user's transport can be determined on the basis of this time-based request, it is possible to determine the delay of the transport (at box 7 in FIG. 1) and to return delay information, i.e., a progression update, (again at box 8 of FIG. 1) concerning the real-time progression of the transport on the basis of the real-time delay entries available in the logbook 5.

In this way, real-time delay information concerning the transport is displayed on a passenger's user device 1. The real-time delay information may include, e.g., the scheduled arrival time of the transport at a station according to the operator's timetable, in particular the next station (the end-point of the current leg), the current time delay of the transport and the respective potential actual arrival at the next and/or final destination.

As outlined above, both the position-related request and the time-related request are associated with a time-stamp. This time-stamp is used to determine the leg at which the transport is supposed to be located at the time of the request and for the calculation of the real-time delay. There are basically two ways to generate the time-stamp. One possibility is to directly include the time stamp in the request by the user device 1. Thus, according to this option, the requests actually contain the time-stamp. The other possibility is to generate the time-stamp only at the reception of the request. This option is particularly useful if the request is processed centrally by a server (as opposed to processing it locally at the user device 1 using the cache mechanism described further below). Generating the time-stamp at the server ensures a consistent time management as all requests are time-stamped by one and the same server-side clock. A similar consistent time management is also possible when using the first option (including the time-stamp in the request), namely if the user devices 1 are synchronized with a trusted clock.

As already indicated above, there are several options how to establish the detailed reference schedule database 4 and to create the necessary arbitrary time-stamped reference positions of the transport. As already explained at the outset above, these time-stamped reference positions are "arbitrary" because they refer to any locations on the route independent from the stations or stops of the transport. The time-stamps thus provide the expected time for the transport to be in the corresponding reference position. One possibility to establish the detailed reference schedule database 4 is the so-called "social approach" which is independent from cooperation of the transport operators. Thus, the social approach can be employed without having to rely on the good will of the operators to deliver detail data about the network and the timing conditions of their transport. The social approach utilizes actual position-based requests issued by the user devices 1 located on the transport. As each of these requests provides a position of the transport and an associated time-stamp (i.e., a time-stamp+position pair), they generally provide a valuable data base. As the entries of the detailed reference schedule database 4 serve as reference time-stamped positions, a validation of the collected data is performed. From the overall number of collected time-stamp+position pairs, those pairs are sought which belong to transports that were on time (i.e., transports which progressed in accordance with the timetable of the operator) and the remaining data sets from transports that were not on time are discarded. This sorting out can be performed by looking at the time-stamp+position pairs with positions in the vicinity of the stations for which the operator has set reference times. If pairs with positions in the vicinity of the stations correspond to the times prescribed by the operator's timetable, the respective transport is considered to have been on time and all time-stamp+position pairs collected from this transport are considered as valid and they are included in the detailed reference schedule database 4.

Further optional alternatives to establish the detailed reference schedule database 4 are artificial requests which could be generated by dedicated staff personnel on the transport, and simulation or provision of respective data by the transport's operators.

The logbook 5 is utilized (box 7 in FIG. 1) in response to requests not indicating the current position of the transport in basically two ways. One way is to simply return the most recent real-time delay entry concerning the transport in the logbook 5 to the requesting user device 1. This option is particularly suitable if this most recent entry in the logbook 5 is up to date and, therefore, reflects the current real-time delay of the transport accurately. The up-to-dateness of the last entry in the logbook 5 is, for example, determined by a comparison of the time-stamp of the logbook entry with the time-stamp associated with the request. If the difference between these two time-stamps is below a given threshold, for example lower than 5, or 10, minutes, or it is still within the current leg of the transport, correctness of the last logbook entry is assumed and the delay information of this most recent logbook entry is returned. The other way of utilizing the logbook 5 for requests not indicating the current position of the transport is extrapolation of the logbook entries in order to assess a trend of the delay. Extrapolation might be considered suitable if the most recent logbook entry is rather old (e.g., the difference between the time-stamp of the last entry and the request is above the given threshold mentioned before), it is therefore presumably out-of-date and may not reflect the actual real-time delay of the transport accurately. An extrapolation technique which may be suitably applied is exponential smoothing. The outcome of the extrapolation is returned to the user device 1.

Similarly, there are various options for the real-time delay calculation (box 12 in FIG. 1) in response to requests indicating the current position of the transport. For example, if the detailed reference schedule database 4 contains a time-stamped reference position which corresponds to the current position of the transport indicated in the request, it is sufficient to calculate the time difference between the reference time-stamp associated with that position in the detailed reference schedule database 4 (i.e., the time at which the transport was expected to reach the reference position) and the time-stamp associated with the request. This time difference between the two time-stamps is the accurate real-time delay of the transport and is returned to the user device 1 (at box 8 in FIG. 1). If, on the other hand, the detailed reference schedule database 4 does not include a reference position corresponding with the position indicated in the request, there are two further options. Either the detailed reference schedule database 4 is searched for the reference position closest to position indicated in the request and the real-time delay is calculated as just described, i.e., by calculating the time difference between the reference time-stamp associated with that position in the detailed reference schedule database 4 and the time-stamp associated with the request. However, this introduces a certain inaccurateness which becomes more substantial the more the two positions (i.e., the position in the detailed reference schedule database 4 and the position in the request) deviate from each other. To minimize this inaccurateness, alternatively, linear interpolation techniques with respect to the time-stamped positions in the detailed reference schedule database 4 in the vicinity of the position indicated in the request may be employed.

It was already briefly outlined above that detailed reference schedule data will exist for each connection and transport to be covered. Thus, the correct transport or the respective connection and the corresponding detailed reference schedule data have to be deduced from the user device's request. One option for making this association between request and transport/connection/detailed reference schedule data is an identification code included in the request which allows identifying the transport. It is then possible to identify the correct timetable data, to the current leg (by using the geo-position contained in the request) and the relevant data in the detailed reference schedule database 4. In one implementation example, this identification code is a Passenger Name Record (PNR) identifier which allows querying a PNR database for itinerary information of the passenger. This itinerary information may include information regarding the connection of the transport the passenger is currently using. Alternatively, an identification code other than a PNR identifier is included in the request. For example, the user device 1 may prompt the user to enter the transport and the connection, respectively, s/he is currently using and the user then manually enters this information which is then included in the request.

In an optional implementation, the position-based determination includes caching the detailed reference schedule database 4 at the requesting user device 1. For example, the user device 1 directs its first position-based request regarding a particular transport to a delay determination server. The server maintains the detailed reference schedule database 4 containing the data associated with the connection of the transport the passenger is currently using. The position-based request of the user device 1 is processed by the delay determination server as described above and the calculated real-time delay is returned to the user device 1. In the optional implementation using caching, however, the detailed reference schedule data belonging to the current transport of the passenger is also transferred to the user device 1, either together with the real-time delay information or in a separate message before or after the real-time delay information was returned by the server. The detailed reference schedule data is then buffered in a cache memory at the user device 1. Consequently, subsequent position-based requests by the same user device 1 can be processed locally at the user device 1, without any need to transmit the position-based request to the delay determination server. In this way, position-based delay calculation becomes possible without the necessity for the user device 1 to activate any external communication link and can, for example, therefore be performed in areas without radio coverage.

If the position-based delay determination is performed locally at the user device 1 using the cached detailed reference schedule database 4 due to the user device 1 lacking a radio link, it is consequently not possible to store the locally calculated real-time delay information in the logbook 5 if the logbook 5 is maintained in the delay determination server. If this happens, the locally calculated delay information will also be buffered locally at the user device 1, in a local logbook. When a radio link is again available at a later point of time, the user device 1 transmits the buffered real-time delay information back to the delay determination server and the information is then incorporated into the (central, server-side) logbook 5.

Caching at the user device 1 is not limited to the detailed reference schedule data of the transport the passenger is currently using. Rather, caching may usefully be extended to other information. For example, further detailed reference schedule data potentially relevant for future transports the passenger is likely going to use, such a connecting transport, may be cached at the user device 1 as well. If feasible in view of available buffer space at the user device 1 and communication link bandwidth available to the user device 1, even more or all detailed reference schedules data which may become relevant to the passenger in the future is transferred to the user device 1 and stored there for local position-based delay determination. Furthermore, in response to the first position-based request by the user device 1, the server-side logbook 5 may also be transferred to the user device 1 and cached there. Although this cached logbook gets out of date and therefore less significant when not updated for a longer period of time, the cached logbook enables a time-based determination to be performed locally at the user device 1 without any need to consult the delay determination server. The extent to which data is cached at the user device is a trade-off between the resources available for the user device (e.g., free buffer space, quality of the communication link) and the potential improvements achievable by the cached data.

The basic approach outlined above, i.e., filling a logbook 5 with real-time delay information by collecting position-based delay requests and their calculation results, may be leveraged to further applications. For example, the information maintained by the logbook 5 may be forwarded to displays at stations, to websites or web services accessible via the Internet, push services like RSS or SMS or any other broadcast-like information distribution channels. Thus, other people which are not travelling on the respective transport can benefit from the present real-time delay determination mechanism, independent from their current location.

In addition, it is within the scope of the approach presented herein to feed the real-time delay system and the logbook 5 by messages which are not necessarily directed to get information about the real-time delay of the transport. Rather, such messages could purely serve the purpose of informing the system about the current delay of the transport without actually requesting the delay. For example, persons like station personnel, actual or potential travellers or other interested people may send messages, for example, by using GSM SMS, to the delay determination server and thereby indicate a location and the current delay of a particular transport. In response to such a message, the delay determination server performs a verification of the information and, if the information is found to be likely valid, adds the delay indication to the logbook 5.

Figure 2:
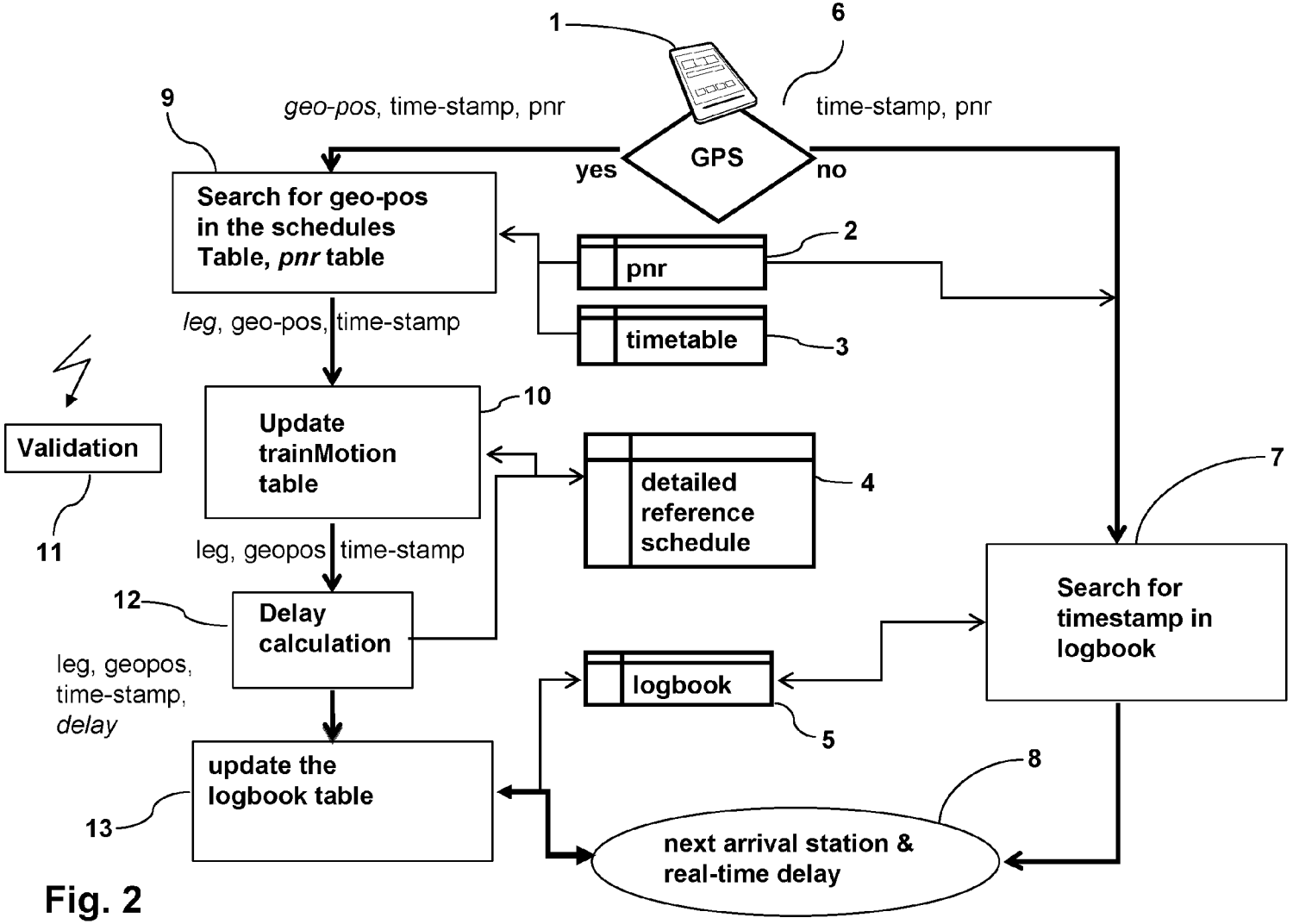
FIG. 2 shows a more specific flow diagram according to an example of the present delay determination.
Figures 3, 4:
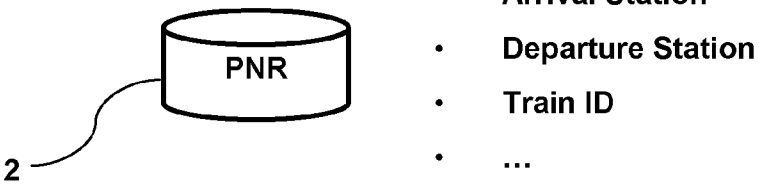
FIG. 3 shows a Passenger Name Record (PNR) database which is utilized in an example of the present delay determination.
FIG. 4 illustrates an exemplary timetable of a scheduled transport.

Now turning to the more detailed description, FIG. 2 shows a more specific example of the present real-time delay determination. Similar to FIG. 1, the left-hand branch of FIG. 2 shows the position-based delay determination, whereas the branch on the right-hand side refers to the time-based delay determination.

In the example of FIG. 2, the user device 1 is a smartphone equipped with a locally installed delay determination application which is arranged to generate delay determination requests. The user device 1 has a graphical user interface that is arranged to display information to the user and to allow user inputs if the user wishes to initiate the present delay determination. The user device 1 is also provided with a mobile communication interface by means of a 2G, 3G and/or 4G transceiver and/or transceivers operating to other mobile communication standards such as WiFi IEEE 802.11. These communication interfaces facilitate mobile communication, in particular transmission of delay determination requests and reception of real-time delay information.

Furthermore, the user device 1 is equipped with a GPS transceiver and, thus, capable of determining its location, provided that a communication link to GPS satellites can be established. If GPS is unavailable for some reason, the user device 1 may employ other position determination methods such as triangulation or Observed Time Difference techniques. If position determination is possible, the user device 1 initiates the position-based delay determination after a respective input command from the user. The user device 1 determines its position and includes the resulting geo-position in the request. Furthermore, a time-stamp indicating the current time is included in the request generated by the user device 1. Alternatively, as explained above, the time-stamp is not included in the request, but only taken at the side of the server for reasons of overall time consistency. Finally, a PNR identification is included in the request. Either the user is prompted to enter the PNR identification, or it is generated automatically if respective information is available locally at the user device 1. When the user device 1 has finished the creation of the position-based request, it transmits the request over a suitable mobile communication link to the delay determination server 47 (the server is not shown in FIG. 2, a high-level architecture of the overall system will be described further below with reference to FIG. 10).

After the request is received by the server, the geo-position and PNR identification included in the request is utilized to determine the transport (more correctly, the connection of the transport) the user is currently located on and, more specifically, the current leg of the route on which the transport is currently located. For this purpose, the delay determination server 47 is suitably coupled to a travel information system such as a PNR database 2. A schematic representation of the PNR database 2 is given by FIG. 3. It includes itinerary information of the user's travel. The travel may be composed of several segments such as a flight from A to B and a connecting train travel from B to C. One of the segments is formed by the current transport on which the user is located and to which the delay determination request relates. In the following example, the transport refers to train travel from B to C for illustrative reasons. However, this example shall not introduce any limitations with respect to the type of transport. For the present purpose of finding out the transport to which the request relates, respective identification information kept in the PNR database 2 is of most interest, i.e., the ID of the train the user is supposed to take for his/her travel from B to C according to the itinerary (cf. FIG. 3).

After obtaining the train ID (for example: "Tr1"), it is possible to reference the correct timetable 3 of the train operator which is also available to the server 47. An example of a timetable 3 is given by FIG. 4. The timetable may include several parameters, among them the TrainID, a StationID ("stID"), geo-positions of the stations ("lat" standing for latitude, "lng" standing for longitude, indicated in degrees) as well as arrival and departure times ("ArrTD", "DepTD"). Thus, according to the very simple example of FIG. 4, the origin station of train Tr1 is St1 which is located at 43,55 degrees lat and 7,02 degrees lng. The train is supposed to depart from there at 7:30. The next stop is intermediate station St2 which is located at 43,59 degrees lat and 7,12 degrees lng. The train should arrive there eight minutes later at 7:38 and leave after a two-minutes stay at 7:40. The final destination is station St3 located at 43,70 degrees lat and 7,28 degrees lng which is supposed to be reached at 08:01. In addition, the timetable 3 may include geo-position information of the stations as well as distance information between the stations, i.e., the length of a leg (not shown in FIG. 4). The goal of querying the timetable 3 is to determine the leg at which the transport is currently located (in other words: the next planned stop according to the operator's timetable 3). Therefore, the geo-position included in the request is passed as an argument of the query to the timetable 3 and the current leg is retrieved. Hence, the process proceeds further with the geo-position (as originally included in the request), the time-stamp (either included in the request or set upon receipt of the request by the server) and the leg (determined from the consultation of PNR database 2 and timetable 3 as just described).

The next step is an update of the detailed reference schedule database 4 (box 10 in FIG. 2). As described already in detail above, the detailed reference schedule database contains arbitrary time-stamped reference positions, i.e., time stamp+position pairs for transports that are on time according to the timetable 3 of the operator. An example of a detailed reference schedule database 4 is given by FIG. 5. It contains the trainID (e.g., Tr1, Tr2), a legID, a time-stamp and a position (lat, lng). According to the example of FIG. 5, train Tr1 is supposed to be at coordinates 43,56 degrees lat, 7,11 degrees lng at 7:35,at 43,57 degrees lat, 7,11 degrees lng at 07:36 and so on. This collection of arbitrary time-stamped reference positions forms a motion curve of the transport (cf. FIG. 7) which is more accurate the more validated data the curve contains.

As described above, one approach to establish and enrich the detailed reference schedule database 4 (shown in FIG. 5 in a table form) is the so-called "social approach", wherein actually occurring position-based user requests are collected and stored in that table. The step of updating 10 the detailed reference schedule database 4 serves exactly this purpose. The step of updating 10 is generally optional because it is not required if already sufficient valid data is present in the detailed reference schedule database 4. Updating 10 means that the geo-position and time-stamp pair is added to the detailed reference schedule database as a reference position. However, if this optional addition is performed, a further process is executed subsequently, namely validation 11. The added time-stamped reference position needs to be validated in order to ensure that it is indeed suitable to act as a reference position. The added time-stamped reference position is only suitable if the transport (i.e., train Tr1 in the present example) is actually on time. As already explained above, the determination whether that particular Tr1 is on time or not can be made by matching the arbitrary time-stamped positions added to the detailed reference schedule database with the reference data of the timetable 3. As long as validation has not yet been performed, the corresponding value in the flag "valid" is set to "No" (cf. FIG. 5). If an entry which has not yet been validated is found to be valid, the value of the "valid" flag is changed to "Yes". If the added time-stamped reference position is found to be invalid (i.e., the train has not been on time), it is deleted from detailed reference schedule database 4.

The position-based delay determination then moves on with the actual calculation of the delay (box 12 in FIG. 2) on the basis of the validated entries of time-stamped reference positions in the detailed reference schedule database 4. The geo-position originating from the request by the user device 1 is tested against the detailed reference schedule database 4. If the detailed reference schedule database 4 contains a reference position exactly matching the geo-position of the request, the reference time can simply be taken out of the detailed reference schedule database 4. Otherwise, the reference time for this geo-position is calculated by linearly interpolating the times associated with the reference positions in the detailed reference schedule database 4 directly before and after the geo-position from the request. Is it also not excluded that the detailed reference schedule 4 only contains very few time-stamped reference positions with respect to the current leg, or no entries at all apart from the stops/stations. This may in particular be the case in the early phase of the deployment of the present delay determination or after the underlying timetable has been changed (which happens to train timetables, for example, two times a year). In this case, the detailed reference schedule 4 will at least contain the data which can be taken from the operator's timetable and the delay is calculated by linearly interpolating the time and geo-position indications.

Figure 6:
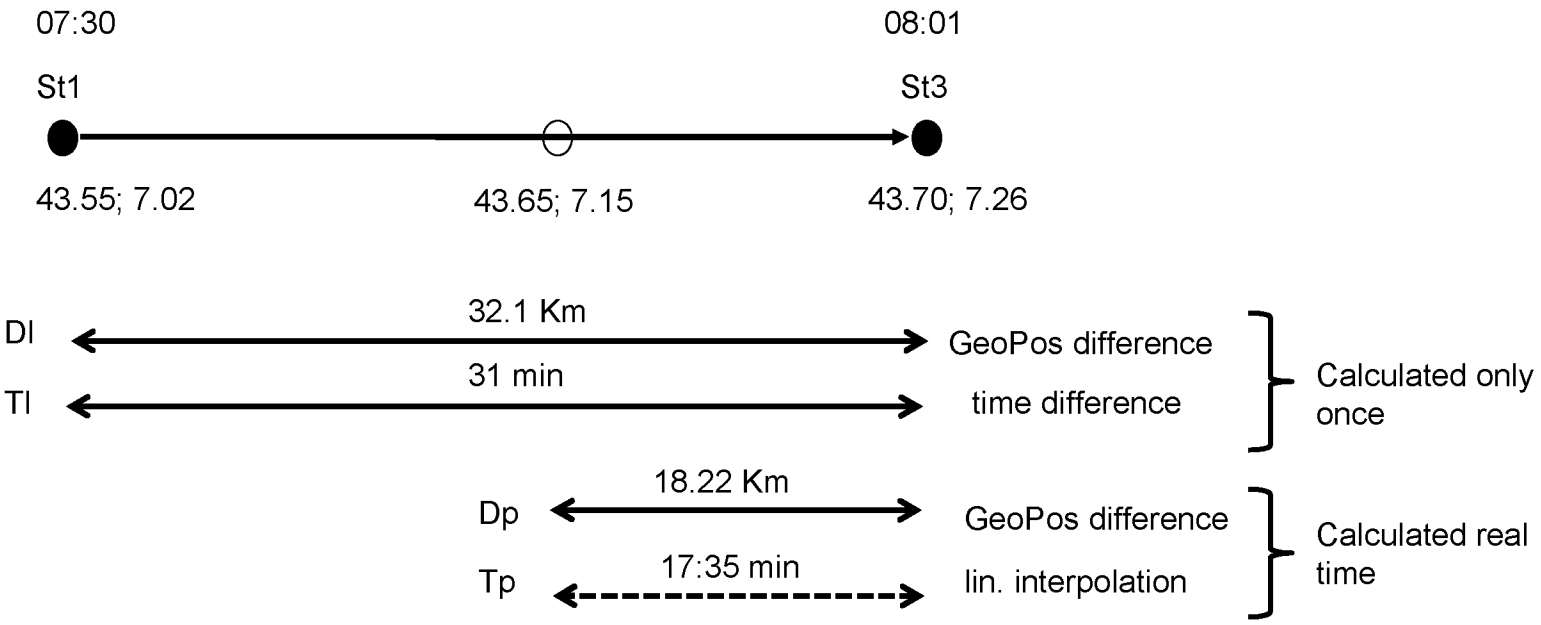
FIG. 6 is a calculation example illustrating reference time calculation using linear interpolation.

An example is given by FIG. 6, which assumes that the detailed reference schedule 4 only contains reference times regarding the departing station St1 (departing at 7:30) and the final destination St3 (arrival at 08:01). The distance between the two stations is either present in the timetable (cf. FIG. 4) or is estimated from the geo-positions of the stations by using the following equations:

$$\text{Distance}(St1_{,}, St3)=\arccos(\cos(lat_, St1-lat_, St3)\cos(lng_, St1)\cos(lng_, St3)+\sin(lng_, St1)\sin(lng_, St3))$$

[Note: Arguments of sines and cosines expressions are given in radians.]

$$\text{Distance in km}=\text{Distance}(St1_{,}, St3)*6372{,}795477598$$

The distance between the current geo-position indicated in the position-based request received from the user device 1 and the next station or reference position in the detailed reference schedule 4 is calculated in the same manner. Then, linear interpolation is performed by using the following rule of three:

$$Tp=TI*Dp/DI$$

wherein Tp is the time needed to reach the next reference position assuming linear progression of the transport, TI is the reference time needed by the transport to complete the trip from the previous to the next reference position, Dp is the distance between the current location and the next reference position and DI is the distance between the two reference positions (cf. specific exemplary numbers given by FIG. 6). Hence, in the example of FIG. 6, train Tr1 should be located at the reference position of 43,65 degrees lat; 7,15 degrees lng indicated in the request at 7:42 and 25 seconds (08:01-17 minutes 35 seconds) which is the resulting reference time calculated from the geo-position indicated in the request and the data contained in the detailed reference schedule 4.

The time difference between this resulting reference time and the time-stamp associated with the request is calculated, and is the desired real-time delay of train Tr1.

Figure 7:
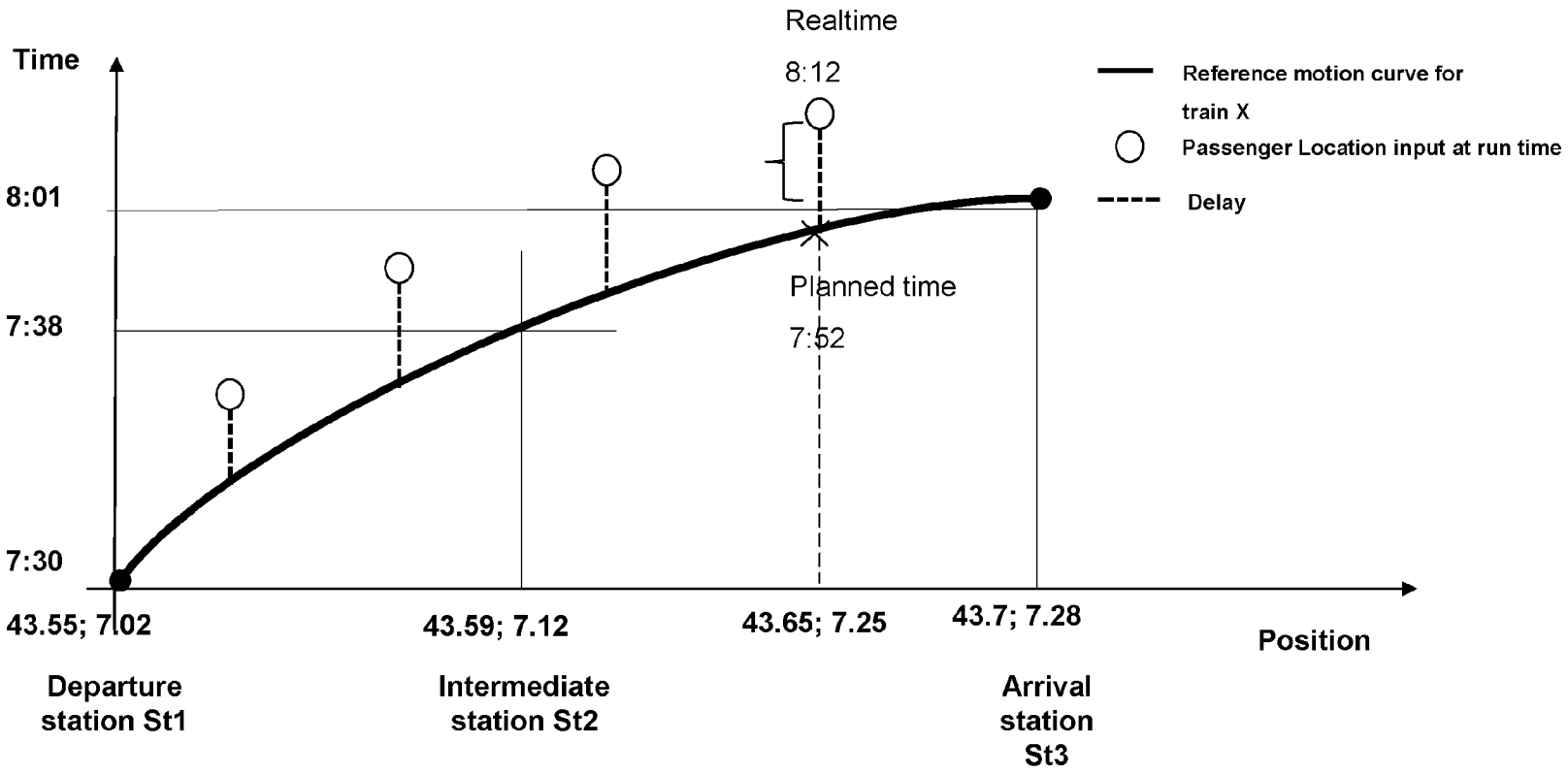
FIG. 7 illustrates an exemplary motion curve of a transport.

An example of the delay calculation 12 according to a position-based request is given with reference to FIG. 7. FIG. 7 depicts the reference motion curve of train Tr1 as prescribed by the detailed reference schedule database 4. The position is plotted on the X axis, and the time plotted on the Y axis of the diagram. As described above, this motion curve is, for example, established by collecting time-stamp+position pairs contained in position based requests relating to transports of the connection in question which were on time. The more entries that are generated and collected in the detailed reference schedule 4, the more accurate and complete the motion curve will be. By using this motion curve, the reference time of train Tr1 is determined with the geo-position included in the request as an input parameter. For example, the geo-position of 43,65 degrees lat, 7,25 degrees lng corresponds to a reference time of 7:52 according to the motion curve. This reference time is then compared with the actual time of the time-stamp associated with the request. If this time-stamp reads 8:12, the real-time delay is 20 minutes.

Referring back to FIG. 2, the position-based delay determination process proceeds with updating the logbook 5 (box 13). As explained already above, the purpose of the logbook 5 is to make the real-time delay information available to passengers who are unable to provide position information with their requests. An example of a logbook 5 is given by FIG. 8. It contains the trainID (e.g., Tr1, Tr2), reference information from the detailed reference schedule database 4 (e.g., "planTime") and the timetable 3 (departing station ["stDep"], next arrival station ["stArr"], planned departure time ["planDep"] and planned arrival time ["planArr"]). In particular, it contains real-time information from the request and the delay calculation, namely the geo-position indicated in the request ("lat, lng"), the time-stamp associated with the request ("realTime"), the delay and the presumed arrival at the next station ("delay", "realArr").

Finally, the requested real-time delay information such as the next arrival station and the real-time delay value is transferred back to the user device 1 (step 8 in FIG. 2) via the mobile communication interface. The client software installed on user device 1 then displays the information to the passenger.

Now turning to the time-based delay determination depicted on the right-hand side of FIG. 2, the user device 1 generates a time-based request without an indication of its current position in situations where the GPS signal is too weak or no GPS link is available at all. Hence, the time-based request only includes a time-stamp (which alternatively might also only be added at the server side) and the PNR identification. The request is transmitted to the server 47. The PNR database 2 and the timetable 3 are consulted in order to determine the trainID as it was described before regarding the position-based determination. After having determined the trainID in this way, the logbook 5 is queried by using the trainID in order to seek potentially existing real-time delay information which has been generated by previous position-based delay determinations. For example, if it is determined that the logbook 5 contains an entry for the present leg of the passenger's train, the delay associated with that entry is taken.

In the example of FIG. 8, train Tr1 is assumed to be on its second leg between stations St2 and St3. According to the timetable, it should have departed at station St2 at 7:40 and arrive at St3 at 8:01 (cf. also FIGS. 4 and 5). Along its travel, two position-based requests have been occurred and processed and the calculated real-time delays have been stored in the logbook 5. The first position-based request occurred at 7:46 while Tr1 was still on its first leg between St1 and St. A delay of 10 minutes was detected. Later on, as Tr1 has progressed to its second leg between St2 and St3, another position-based request was received at 8:12, and a further increased delay of 20 minutes was determined. Now assuming that a time-based request is received by server 47 at 8:15, the logbook 5 is consulted and the 8:12 entry regarding the current leg of train Tr1 which is only three minutes old is found. The delay value of this entry, i.e., a delay of 20 minutes, is determined (box 7 in FIG. 2). The delay and, for example, the next arrival station St3 is then returned to the user device 1 which displays the information to the passenger.

Figure 9A:
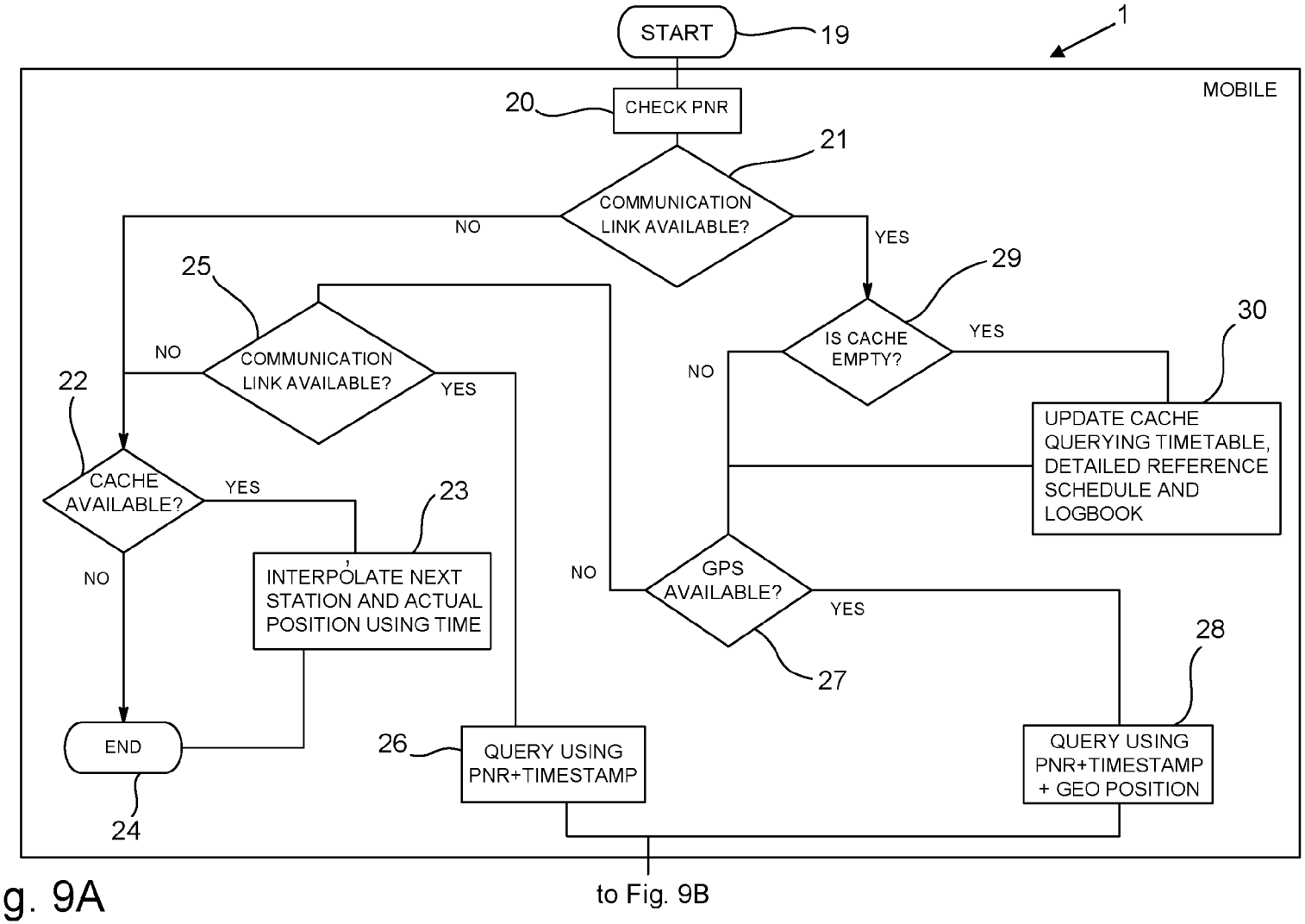
FIGS. 9*a*, 9*b*, and 9*c* depict a detailed flow diagram showing the procedures in the user device and on the server side according to an implementation example of the present delay determination.
Figure 9B:
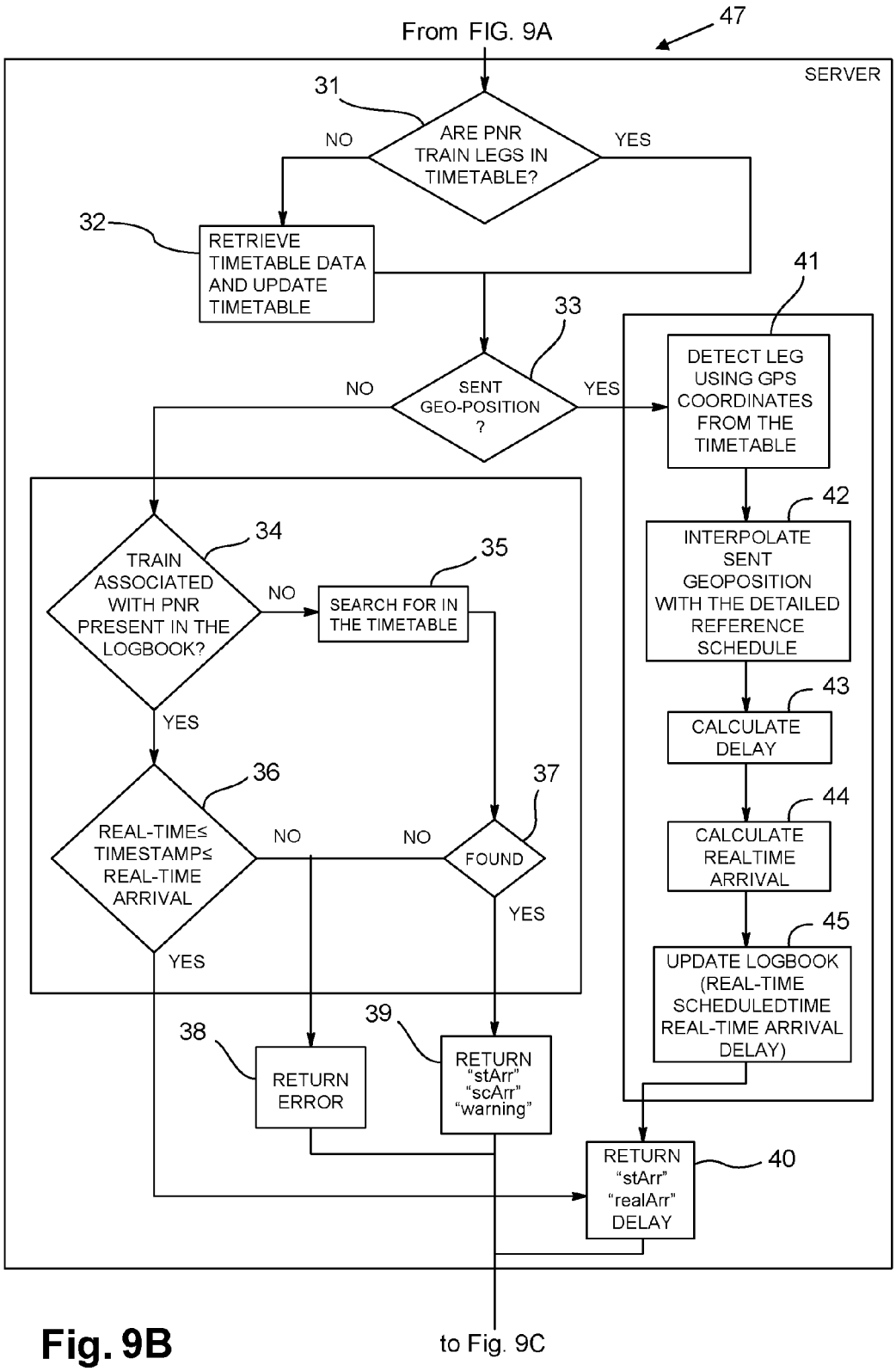
Figure 9C:
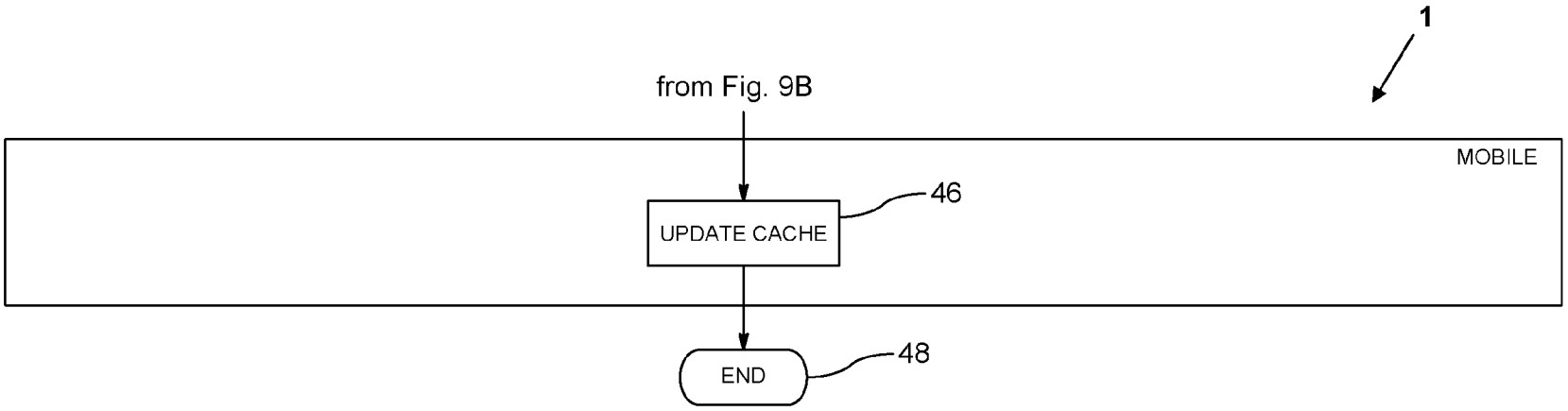

In the following, an implementation example of the position-based and time-based delay determination including the caching function already outlined above will be discussed in more detail with reference to the flow diagrams of FIGS. 9*a*, 9*b*, and 9*c*. FIG. 9*a*, depicts the processes going on at the user device 1 until a request for delay determination is issued. FIG. 9*b*, shows the processing of the request at the server 47. Finally, FIG. 9*c*, visualizes the action again at the side of the user device 1, after the delay determination result has been return by the server 47.

Generally, the relevant data flows can be categorized according to the following conditions:

Both, position determination function and mobile communication link are available at the user device 1.

Position determination function is available. However, a mobile communication link is unavailable.

Position determination function is not implemented or is temporarily unavailable. However, a mobile communication link is available.

Neither a position determination function nor a mobile communication link are available.

The data flow in case (i) (position determination function and mobile communication link are available) is as follows:

After the start at 19, the process commences with a validity check 20 of the PNR identification which is either present within the user device 1 or was entered manually by the user. Then, after having positively confirmed the availability of a mobile communication link at 21, the user device 1 verifies the cache at 29. If the cache is empty, the mobile communication link is utilized in order to download detailed reference schedule data and current delay information regarding the transport referenced by the PNR identification. For this purpose, a cache update message is transmitted to the server 47 at 30. In response to the cache update message, the server 47 queries its databases (i.e., PNR database 2, timetable 3, detailed reference schedule 4 and logbook 5) and returns the corresponding data to the user device 1. The user device 1 stores this data in its cache. The cache then contains, for example, the timetable data regarding the present transport, in particular the next arrival station, the detailed reference schedule data for the present transport and recent train delay information of the present transport available in the logbook 5. This information will be enough to calculate or estimate the real-time delay of the present transport in the absence of a position determination function and/or mobile communication link.

Further on, the user device 1 checks at 27 whether a GPS signal is available with a positive outcome. The user device 1 then generates a position-based request at 28 and transmits the request to the server 47. At the server side (FIG. 9*b*), the server 47 checks at 31 whether a timetable 3 relating to the transport the passenger is currently using is already available. If this is not the case, the respective timetable information may be retrieved by the operator of the transport at 32. In order to be able to include this data as fast as possible, the server 47 suitably has a communication link to the operator and its timetable database.

After having positively determined at 33 that the request received by the user device 1 includes a geo-position, the server 47 optionally performs a validation of the geo-position included in the request (not shown in FIG. 9*b*). The function of this validation is to ensure that the geo-position contained in the request corresponds to a position within the route of the transport, i.e., a position that is in line with the route of the train indicated by the PNR. In order to perform this validation, a description of the train's route in terms of its geo-position is available to the server 47. The geo-position indicated in the request is then compared with the geo-position reference of the route. If the geo-position of the request is determined to be "within the route", i.e., it corresponds or at least approximately corresponds to a location on the route, the geo-position of the request is considered to be valid. The geo-position reference information of the route may be obtained from the transport operator, an external map service, estimated by the operator of the server 47, and/or collected by and deduced from a significant number of received position-based requests. Additionally, requests indicating geo-positions on or close to the route, but substantially remote from the actual position of the train (such as generated by future passengers already waiting at subsequent stations or former passengers who already left the train at a previous station) may be filtered out by aligning the geo-position and time-stamp pair of the request with the information already contained in the detailed reference schedule 4 and/or the logbook 5. For example, a request indicating a geo-position which the train has already passed can be filtered out if the logbook 5 contains entries for geo-positions already further down the route (such outdated requests may be still processed on the basis of the logbook 5 and, for example, the latest real-time delay contained in the logbook 5 may be returned). As another example, a request indicating a future geo-position which the train cannot have already reached by taking into account the entries of the logbook 5 may be filtered out as well (similarly, in response to such requests, the latest real-time delay information may nevertheless be returned). Generally, if the geo-position indicated by the request is determined to be unrelated to the current position of the train, such a request may be treated similarly to a time-based request, i.e., the geo-position is considered to be absent and real-time information may be returned by utilizing the logbook 5.

Subsequent to this optional validation step, the server 47 executes the position-based delay determination (shown at the right-hand side of FIG. 9*b*). As explained in detail already above with reference to FIG. 2, this process includes:

determining the current leg at 41 by querying the timetable 3 using the geo-position included in the user device's request;

querying the detailed reference schedule 4 at 42 with leg and geo-position and, if applicable, interpolating time-stamped reference positions kept in the detailed reference schedule 4;

calculating the real-time delay and corresponding estimated arrival time at the next station at 43 and 44; and at 45, updating the logbook 5 with at least the time-stamp ("realTime"), the calculated real-time delay ("delay") and estimated actual arrival time ("realArr") at the next station ("stArr").

Then, the server 47 returns the resulting real-time delay information such as next arrival station, estimated actual arrival time and calculated real-time delay to the user device 1 at 40. After having received the respective message over the mobile communication link (FIG. 9*c*), the user device 1 updates its own cache with this information at 46 and presents the information to the user via its graphical user interface. The process terminates at 48.

The data flow in case (ii) (position determination function available-mobile communication link unavailable) is as follows:

If the unavailability of the mobile communication link is determined already at the outset at 21, the user device 1 checks whether cached information relating to the transport indicated by the user is available at 22. If the cached information or data is available, delay determination is possible locally at the user device 1 at 23. Provided that the cached data includes the detailed reference schedule data concerning the user's transport, a position-based request is generated and processed internally by the user device 1 in a similar manner as it would have been processed by the server 47 in case the mobile communication link would have been available. The only basic difference is that updating the logbook 5 with the server at 45 is impossible for the user device 1 without a mobile communication link. Hence, the user device 1 buffers the relevant data in a local logbook for updating the server-side logbook 5 at a later time, when the mobile communication link becomes available again (this activity is not shown in FIG. 9*a*). The delay information calculated locally by the user device 1 is presented to the user and the process ends at 24.

The data flow in case (iii) (a mobile communication link available, position determination function unavailable) is as follows:

In this case, the time-based delay determination is performed. The process starts again at the user device 1 with steps 19 to 21, 29 and 30 as described above with reference to data flow case (i). At 27, the user device 1 determines that a GPS signal is not available. The presence of the mobile communication link is then re-verified at 25.

Should the mobile communication link be lost in the meantime, delay determination is then generally possible locally at steps 22 and 23 because the cache has been updated before at steps 29 and 30 and the necessary reference and logbook data should be present locally in the cache. As the present position is unknown to the user device 1 in the present scenario, the local delay determination will either correspond to the time-based delay determination as it would have been performed by the server 47 (as described subsequently with reference to FIG. 9*b*), provided that logbook data is available. Alternatively, if no logbook data is cached (for example, because there have not been any position-based requests concerning the current travel of the transport beforehand), at least the reference data contained in the timetable 3 can be displayed to the user. In this branch, the process then terminates at 24.

If the re-verification at 25 confirms that the mobile communication link is still present or available, the user device 1 generates a time-based request at 26. The request includes the PNR identification and the time-stamp of the current time (as stated above, it is also possible that the time-stamp is only added later by the server 47 when it receives the request). At the server side (now referring again to FIG. 9*b*), steps 31 and 32 are executed as described before. The determination at 33 shows that the request does not include a geo-position, i.e., that it is a time-based request. Hence, server 47 performs the time-based delay determination, visualized on the left-hand of FIG. 9*b*.

At 34, the server 47 checks whether the transport indicated by the PNR identification is present in the logbook 5. If this is not the case, the server at least tries to retrieve the timetable information at steps 35 and 37 and returns, for example, the next arrival station and the scheduled arrival to the user device 1 at 39. A warning or remark might be included emphasizing that this is only the scheduled, but not the actual arrival time. If even the scheduled information contained in the timetable 3 is not accessible for some reason, an error message will be returned to the user device 1 at 38.

If the test at 34 determines that real-time delay information regarding the user's current transport is available in the logbook 5, the time-based delay calculation is performed at 36. The entries in the logbook 5 pertaining to the current leg of the transport are retrieved by applying the constraint realTime≤time-stamp≤realArr. The parameters "realTime" and "realArr" are part of the logbook entries (cf. FIG. 8). The "realTime" values correspond to the time-stamps of the previous position-based requests which have been led to the entries of the logbook 5. The "realArr" values refer to the actual arrival at the next station which was estimated by the previous real-time delay determinations. Hence, the logbook entries having values of "realTime" lower than or equal to the value of the time-stamp associated with the current time-based request contain results of previous delay determinations. Logbook entries having values of "realArr" equal to or greater than the value of the time-stamp associated with the current time-based request are presumably referring to the current leg on which the user's transport is located. If "realArr" is, however, lower than the time-stamp of the request, it can be assumed that the respective entry refers to a previous leg and the transport has already reached the next arrival station. This could be an indication that the delay indicated by this entry is not up-to-date anymore.

The way of calculating the real-time delay depends on the number logbook entries and their time values. For example, if the logbook 5 contains one entry referring to the current leg of the transport, the next arrival station ("stArr"), the estimate arrival time ("realArr") and the delay value ("delay") of that logbook entry are retrieved at 36 and returned to the user device 1 at 40. If, on the other hand, no logbook entry fulfils the above condition (i.e., realTime≤time-stamp≤realArr), only an error message may be returned at 38. Alternatively, at least the scheduled information (next arrival station, scheduled arrival) may be retrieved from the timetable 3 and returned to the user device 1. If the logbook 5 contains several entries which, however, only pertain to previous legs (i.e. time-stamp≥realArr), an extrapolation may be performed on the delay values of these older entries and the resulting delay value may be returned as a rough estimation. In this case, again a warning or remark could be added that the delay information may be inaccurate. In the end, the process returns to the user device 1 (FIG. 9*c*). If feasible (i.e. if real-time delay information was provided by the server 47), the user device 1 updates its cache at 46 and the process terminates at 48.

Finally, the data flow in case (iv) (no position determination and no mobile communication link available) is as follows:

If the user device 1 already initially determines the unavailability of the mobile communication link at 21, local time-based delay determination may be possible if logbook data has been cached previously, or at least timetable data may be presented to the user. In this case, the description of steps 22 and 23, which has been given above with reference to case (ii), may apply. If no logbook and/or timetable data is available in the cache and the check at 22 is therefore unsuccessful, the process terminates at 24.

If the mobile communication link is, however, available at 21, the cache is updated at 29 and 30. If the mobile communication link is subsequently released and the absence of the link is determined at 25, time-based delay determination should be possible at 22 and 23. This is similar to the time-based delay determination by the server which has been described in detail before with reference to case (iii). In this case, the process likewise terminates at 24.

Figure 10:
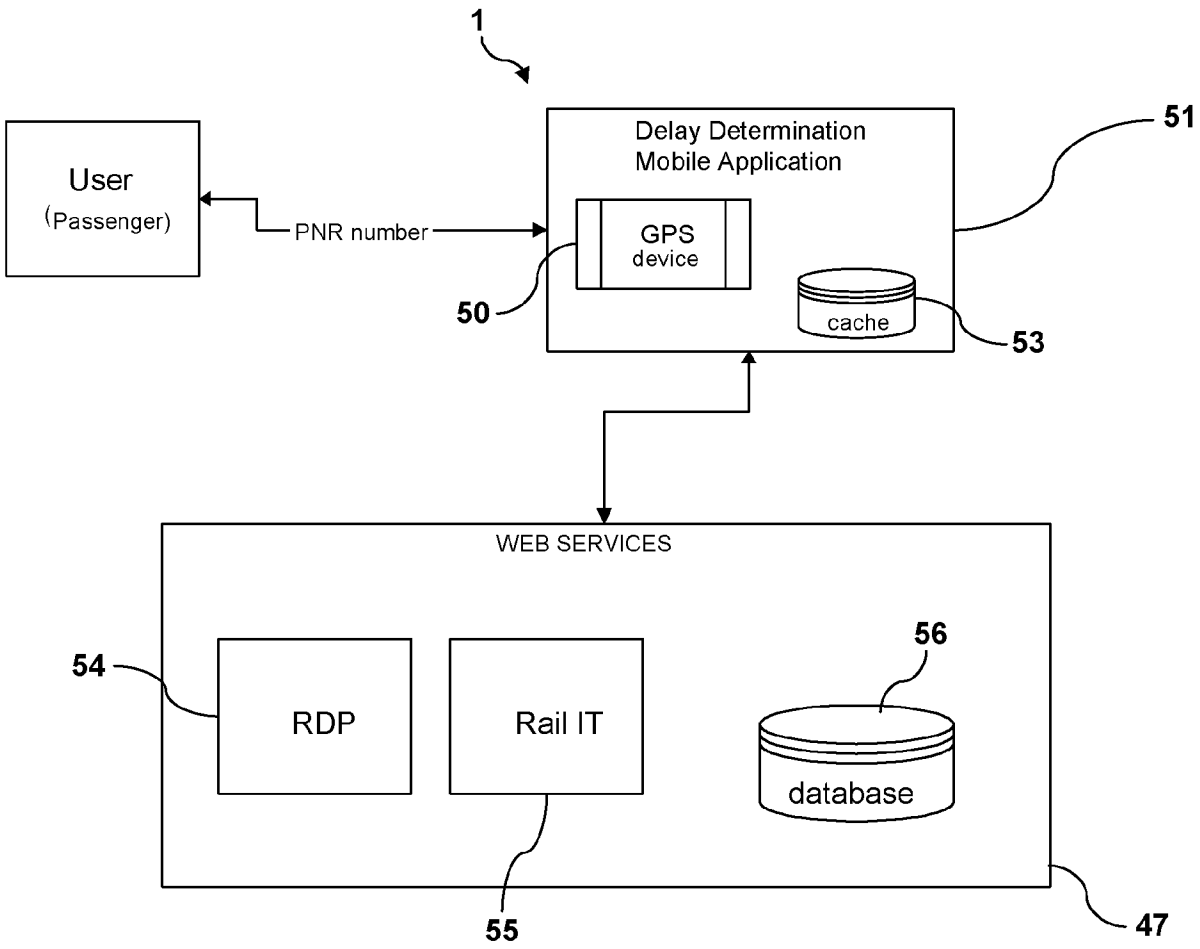
FIG. 10 illustrates the architecture of an exemplary system arranged to perform the present delay determination.

FIG. 10 presents a high-level overview of a possible architecture for the present delay determination system. In this example, the user device 1 includes a position determination function in the form of a GPS transceiver 50. To implement the caching function, a certain portion of the user device's memory (either a volatile RAM or a non-volatile memory such as a flash memory) is utilized as a cache 53. The client-related functions of the present delay determination are implemented by a delay determination mobile application 51. Communication with the user/passenger is possible via a graphical user interface such as a touchscreen. The graphical user interface is, inter alia, used by the user for entering his/her itinerary information, such as a PNR number, or transport connection information, and for displaying the real-time delay information.

On the other hand, a server side 47 provides web services to the user devices 1. The server side 47 comprises infrastructure which maintains the underlying data, in particular the timetables 3, the detailed reference schedules 4 and the logbooks 5. In the example being directed to real-time delay calculation of trains, the server-side infrastructure comprises a Rail Distribution Platform 54 (RDP), a RailIT server 55 and a database 56.

Figure 11:
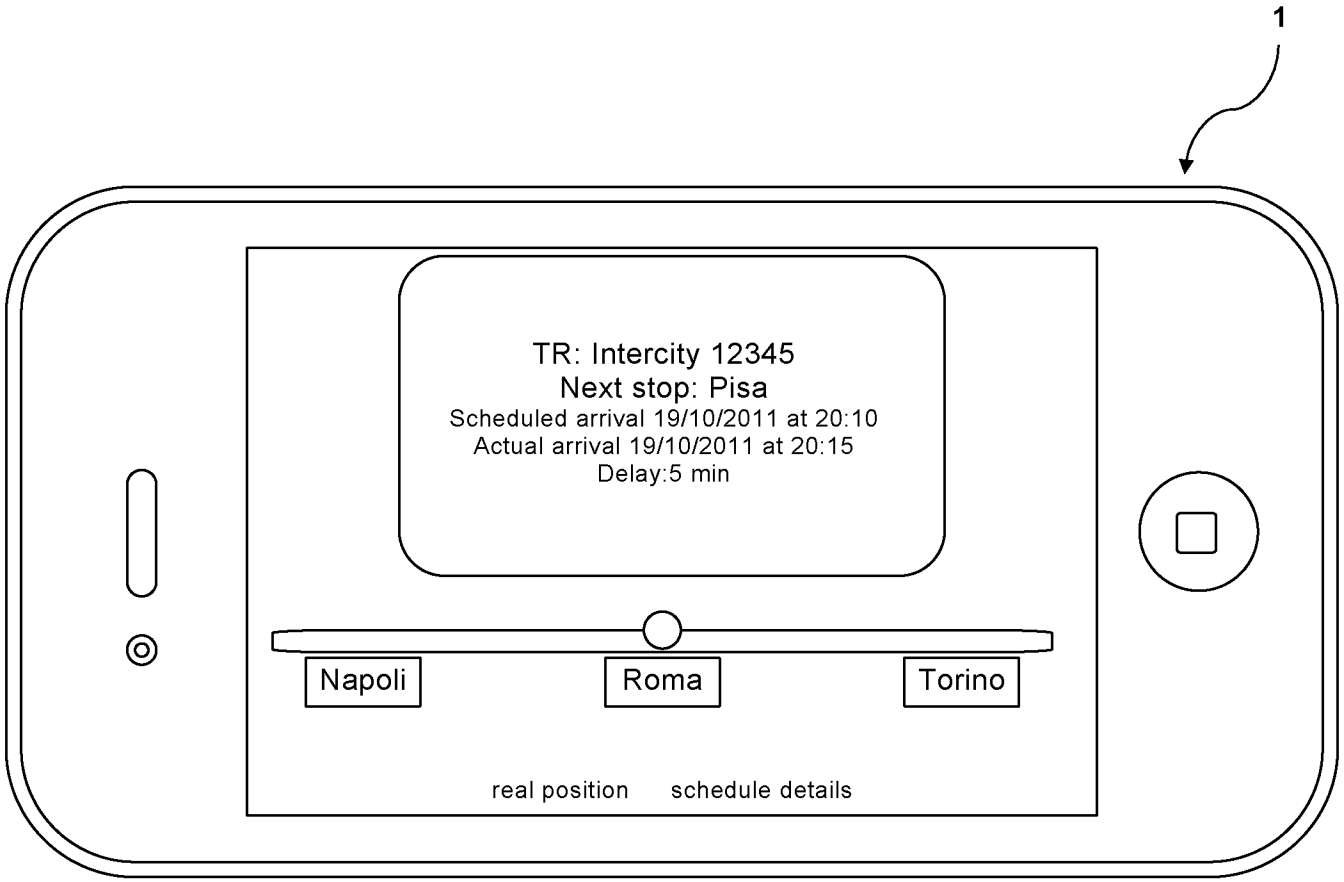
FIGS. 11 and 12 illustrate the graphical user interface of a user device running an application performing the present delay determination.
Figure 12:
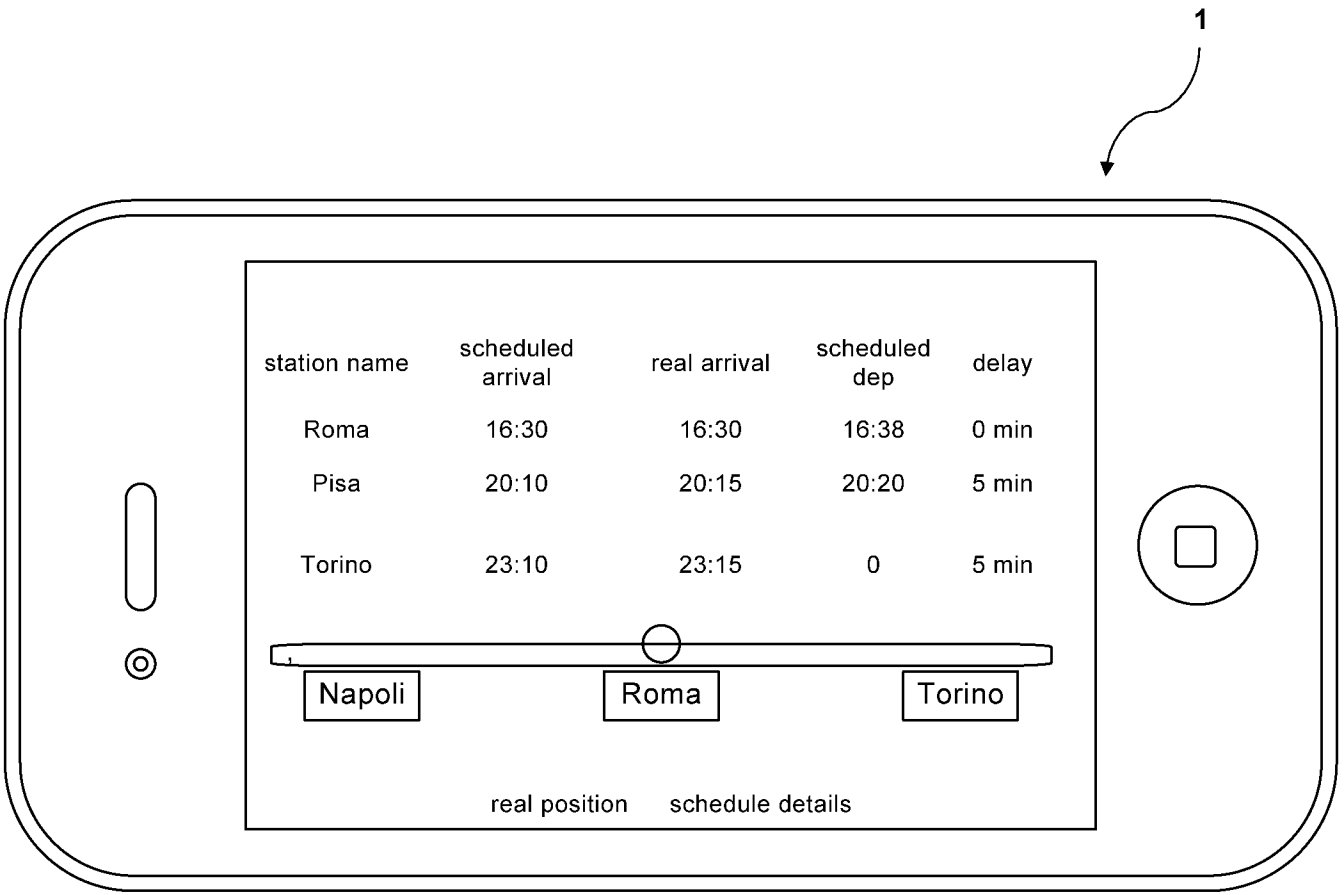

FIGS. 11 and 12 visualize an example of a graphical user interface of an exemplary user device 1 by means of which the software installed on the user device 1 displays the determined real-time delay information to the user. The main screen as depicted by FIG. 11 shows the identification information of the transport ("Intercity 12345"), the next planned stop ("Pisa"), scheduled information related to this next station ("Scheduled arrival 19/10/2011 at 20:10), the estimated actual arrival at that station ("Actual arrival 19/10/2011 at 20:15) and the delay ("Delay: 5, min") Further below, the actual position of the transport and certain important stops ("Napoli", "Roma", "Torino") are indicated. Those stations at which the transport was on time may be specifically highlighted, for example by green background colour. Stations at which the transport was or is probably going to be delayed may be highlighted in a different fashion, for example by red background colour. A button, for example labelled "schedule details", leads the user to a table-like overview of the scheduled and calculated arrival/departure times for the major stations (shown by FIG. 12). Additionally or alternatively, a full list of legs and upcoming arrival stations along with the scheduled arrival/departure times and the calculated ones is presented.

Figure 13:
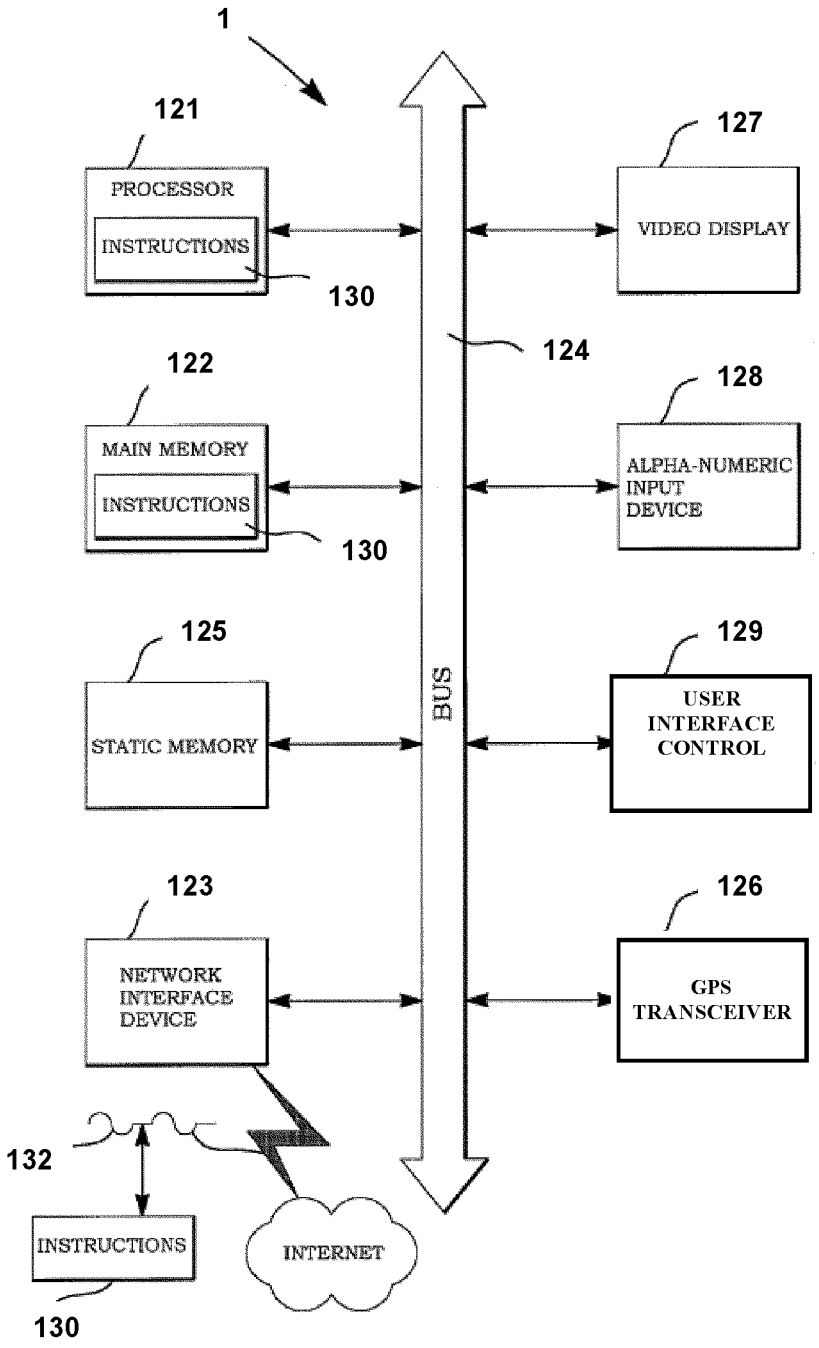
FIG. 13 is an exemplary schematic view of the internal architecture of a user device.

Finally, FIG. 13 is a diagrammatic representation of the internal structure of a user device 1. The user device 1 is arranged to execute a set of instructions, to cause it to perform any of the methodologies discussed herein. The mobile communication device, or user device 1 includes a processor 121, a main memory 122 and a wireless network interface 123 (such as a Wi-Fi and/or Bluetooth interface) and/or a 2G/3G/4G mobile network interface device (not shown), all of which communicate with each other via a bus 124. The user device 1 further includes a static memory 125, e.g. non-removable flash or solid state drive or a removable Micro or Mini SD card, which permanently stores the software enabling the user device 1 to execute the local delay determination functions and to communicate with the server-side infrastructure 47. Furthermore, the user device 1 includes a display 127, preferably a touch screen, a user interface (touch screen) control module 129 and, optionally, an additional (non-virtual) alpha-numeric and cursor input device 128 (if such an input device is present). The wireless network interface device 123 connects the user device 1 to the server-side infrastructure 47. An optional GPS transceiver 126 provides for location determination. A set of instructions (i.e., software) 130 embodying any one, or all, of the methodologies described above, resides completely, or at least partially, in the static memory 125. When being executed, respective instructions and/or data reside in the main memory 122 and/or the processor 121. The software 130 may further be transmitted or received as a propagated signal 132 through the wireless network interface device 123 or the 2G/3G/4G mobile network interface from/to the a server within the server-side infrastructure depicted by FIG. 10 or the Internet.

The server-side infrastructure 47 is constructed in a similar way with the exception that some or all of these components may not have any wireless network interfaces and GPS modules.

Each computing system described herein, also referred to as a platform, client, server, or back end, may include at least one processing unit configured to execute one or more instructions to perform one or more operations consistent with embodiments of the invention. Each computing system generally includes an input/output ("I/O") interface, a display, and external devices. The I/O interface may be configured to receive data from the display and data from the external devices that is communicated to the processing unit and may be configured to output data from the processing unit to the display and external devices. The display may be, for example, a computer monitor or a screen on a mobile phone or a tablet. Alternatively, the display may be a touch screen that not only functions to permit a user to receive and view output data, but also functions to permit the user to input data with, for example, an onscreen virtual keyboard. The external devices may include, for example, additional user input devices such as a keyboard, a keypad, a mouse, a microphone, etc., and additional user output devices such as speakers, etc. The computing system may also include a network adapter, such as a network interface card or a transceiver, that supplies the physical connection with a network and that is configured to transmit data and receive data over the network.

Each computing system includes a memory configured to store one or more software modules or applications and/or an operating system, where each application and the operating system each generally comprise one or more instructions stored as program code that may be read from the memory by each processing unit. The instructions, when executed by the processing unit, may cause the processing unit to perform one or more operations to thereby perform the steps necessary to execute steps, elements, and/or blocks embodying the various embodiments of the invention.

The memory may represent random access memory (RAM) comprising the main storage of a computer, as well as any supplemental levels of memory, e.g., cache memories, non-volatile or backup memories (e.g., programmable or flash memories), mass storage memory, read-only memories (ROM), etc. In addition, the memory may be considered to include memory storage physically located elsewhere, e.g., cache memory in a processor of any computing system in communication with the client device 16, as well as any storage device on any computing system in communication with the client device 16 (e.g., a remote storage database, a memory device of a remote computing device, cloud storage, etc.).

The routines and/or instructions that may be executed by the one or more processing units to implement embodiments of the invention, whether implemented as part of an operating system or a specific application, component, program, object, module, interface, engine element, tool, or sequence of operations executed by each processing unit, is referred to herein as "program modules", "computer program code" or simply "modules" or "program code." Generally, program modules may include routines, programs, objects, components, logic, data structures, and so on that perform particular tasks or implement particular abstract data types. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. Given the many ways in which computer code may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The flowcharts, block diagrams, and sequence diagrams herein illustrate the architecture, functionality, and operation of possible implementations of systems, methods, and computer program products according to various embodiments of the present invention. In this regard, each block in a flowchart, block diagram, or sequence diagram may represent a segment or portion of program code, which comprises one or more executable instructions for implementing the specified logical function(s) and/or act(s). Program code may be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the blocks of the flowcharts, sequence diagrams, and/or block diagrams herein. In certain alternative implementations, the functions noted in the blocks may occur in a different order than shown and described. For example, a pair of blocks described and shown as consecutively executed may be instead executed concurrently, or the two blocks may sometimes be executed in the reverse order, depending upon the functionality involved. Each block and combinations of blocks can be implemented by special purpose hardware-based systems that perform the specified functions or acts, or combinations of special purpose hardware and computer instructions.

The program code of any of the embodiments described herein is capable of being individually or collectively distributed as a program product in a variety of different forms. In particular, the program code may be distributed using a computer readable media, which may include computer readable storage media and communication media. Computer readable storage media, which is inherently non-transitory, may include volatile and non-volatile, and removable and non-removable tangible media implemented in any method or technology for storage of information, such as computer-readable instructions, data structures, program modules, or other data. Computer readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

While the invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative methods, and illustrative examples shown and described. Accordingly, departures may be made from such details without departing from the spirit or scope of applicants' general inventive concept.

What is claimed is:

1. A method of updating an end-user with respect to a scheduled transport, the method comprising:

receiving, in a server, a first request for a first progression update for the scheduled transport from a first user device on or at the scheduled transport, the first request including data indicating a current position of the scheduled transport;

in response to receiving the first request, determining, by the server, the current position of the scheduled transport based on the data indicating the current position of the scheduled transport in the first request;

querying, by the server, a detailed reference schedule database for an expected time for the scheduled transport to be in the current position;

determining, by the server and based on the current position of the scheduled transport, a first time difference between a real-time the scheduled transport is in the current position and the expected time for the scheduled transport to be in the current position;

returning, by the server, the first progression update to the first user device, the first progression update including the first time difference determined by the server;

storing, by the server, the first time difference and the current position of the scheduled transport as a time-stamped entry in a logbook database;

receiving, in the server, a second request for a second progression update from a second user device;

in response to receiving the second request, querying, by the server, the logbook database for the first time difference;

determining, by the server, a second time difference between the real-time the scheduled transport is in the current position and the expected time the scheduled transport is to be in the current position based on the first time difference obtained from the logbook database; and returning, by the server, the second progression update to the second user device, the second progression update including the second time difference.

2. The method of claim 1 wherein the detailed reference schedule database includes a plurality of time-stamped reference positions corresponding to the expected progression of the scheduled transport.

3. The method of claim 2 wherein the first request is one of a plurality of first requests each including data indicating the current position of the scheduled transport, and further comprising:

validating the first requests by discarding first requests that are not associated with progression updates indicating that the scheduled transport is on-time;

associating a time-stamp with the current position in each first request of the validated first requests; and storing the time-stamped current position data of the validated first requests in the detailed reference schedule database to define the plurality of time-stamped reference positions.

4. The method of claim 2 further comprising:

determining a reference motion curve for the scheduled transport based on the plurality of time-stamped reference positions.

5. The method of claim 1 further comprising:

caching the detailed reference schedule database in the first user device, wherein the detailed reference schedule database queried for the expected time for the scheduled transport to be in the current position is the cached database.

6. The method of claim 1 wherein determining the first time difference further comprises:

associating a time-stamp with the first request; and comparing the time-stamp to the expected time to determine the first time difference.

7. The method of claim 6 wherein associating the time-stamp with the first request comprises determining a time the first request was received.

8. The method of claim 6 wherein associating the time-stamp with the first request comprises reading time-stamp data included in the first request.

9. The method of claim 1 wherein the logbook database is queried for the first time difference in response to the second request not including the data indicating the current position of the scheduled transport.

10. The method of claim 1 wherein determining the second time difference between the real-time the scheduled transport is to be in the current position and the expected time the scheduled transport is to be in the current position based on the first time difference obtained from the logbook database comprises:

extrapolating a plurality of stored first time differences in the logbook database to assess a trend in the stored first time differences; and determining the second time difference based on the trend.

11. The method of claim 1 wherein determining the second time difference between the real-time the scheduled transport is to be in the current position and the expected time the scheduled transport is to be in the current position comprises:

receiving a most recently stored first time difference in the logbook database.

12. The method of claim 1 further comprising:

caching the logbook database in the second user device, wherein the logbook database queried for the first time difference between the real-time the scheduled transport is in the current position and the expected time the scheduled transport is to be in the current position is the cached database.

13. The method of claim 1 wherein the first request includes an identification code, the method further comprising:

determining the expected progression of the scheduled transport based on the identification code.

14. The method of claim 1 wherein the first request includes an identification code, and further comprising:

querying a passenger name record database for itinerary information related to the identification code; and determining a current leg of the scheduled transport based on the itinerary information.

15. The method of claim 1 further comprising:

determining that the first request includes data indicating the current position of the scheduled transport by validating that the current position indicated by the data corresponds to a position within a route of the scheduled transport.

16. The method of claim 1 further comprising:

prompting the end-user of the first user device to enter information identifying the scheduled transport; and determining a current leg of the scheduled transport based on the information identifying the scheduled transport.

17. A computer system for updating an end-user with respect to a scheduled transport, the computer system comprising:

a processor;

a logbook database;

a detailed reference schedule database; and a memory including a set of instructions that, when executed by the processor, cause the computer system to:

receive a first request for a first progression update for the scheduled transport from a first user device on or at the scheduled transport, the first request including data indicating a current position of the scheduled transport;

in response to receiving the first request, determine the current position of the scheduled transport based on the data indicating the current position of the scheduled transport in the first request;

query the detailed reference schedule database for an expected time for the scheduled transport to be in the current position;

determine, based on the current position of the scheduled transport, a first time difference between a real-time the scheduled transport is in the current position and the expected time for the scheduled transport to be in the current position;

return the first progression update to the first user device, the first progression update including the first time difference determined by the computer system;

store the first time difference and the current position of the scheduled transport as a time-stamped entry in the logbook database;

receive a second request for a second progression update from a second user device;

in response to receiving the second request, query the logbook database for the first time difference;

determine a second time difference between the real-time the scheduled transport is in the current position and the expected time the scheduled transport is to be in the current position based on the first time difference obtained from the logbook database; and return the second progression update to the second user device, the second progression update including the second time difference.

18. A computer program product for providing updating an end-user with with respect to a scheduled transport, the computer program product comprising:

a non-transitory computer readable storage medium; and a set of instructions stored on the computer readable storage medium that, when executed by a processor, cause the processor to:

receive a first request for a first progression update for the scheduled transport from a first user device on or at the scheduled transport, the first request including data indicating a current position of the scheduled transport;

in response to receiving the first request, determine the current position of the scheduled transport based on the data indicating the current position of the scheduled transport in the first request;

query a detailed reference schedule database for an expected time for the scheduled transport to be in the current position;

determine, based on the current position of the scheduled transport, a first time difference between a real-time the scheduled transport is in the current position and an expected time for the scheduled transport to be in the current position;

return the first progression update to the first user device, the first progression update including the first time difference determined by the processor;

store the first time difference and the current position of the scheduled transport as a time-stamped entry in a logbook databases;

receive a second request for a second progression update from a second user device;

in response to receiving the second request, query the logbook database for the first time difference;

determine a second time difference between the real-time the scheduled transport is in the current position and the expected time the scheduled transport is to be in the current position based on the first time difference obtained from the logbook database; and return the second progression update to the second user device, the second progression update including the second time difference.

* * * * *